US005860530A

United States Patent [19]

Simmons et al.

[11] Patent Number: 5,860,530

[45] Date of Patent: Jan. 19, 1999

[54] CONTAINER WITH A CORNER LATCH CLOSURE

[75] Inventors: Kenneth J. Simmons, Stanley; Donald E. Rowe, Newark; Richard A. Cummings, Canandaigua; Phillip S. Baker, Fairport, all of N.Y.

[73] Assignee: Tenneco Packaging Inc., Evanston, Ill.

[21] Appl. No.: 885,081

[22] Filed: Jun. 30, 1997

[51] Int. Cl.[6] ..... B65D 1/36

[52] U.S. Cl. ..... 206/557; 229/407; 229/902

[58] Field of Search ..... 206/557, 216, 206/1.5; 229/406, 407, 902, 904, 938

[56] References Cited

U.S. PATENT DOCUMENTS

| | | | |
|---|---|---|---|
| D. 259,543 | 6/1981 | Commisso et al. | D7/85 |
| D. 262,866 | 2/1982 | Commisso | D9/347 |
| D. 262,944 | 2/1982 | Commisso | D9/347 |
| D. 263,023 | 2/1982 | Commisso | D9/347 |
| D. 269,854 | 7/1983 | Commisso | D9/347 |
| D. 272,595 | 2/1984 | Chase et al. | D7/16 |
| D. 273,844 | 5/1984 | Bixler et al. | D9/345 |
| D. 274,790 | 7/1984 | Bixler et al. | D9/345 |
| D. 276,216 | 11/1984 | Michaud | D9/425 |
| D. 281,042 | 10/1985 | Antoni et al. | D7/5 |
| D. 282,147 | 1/1986 | Mangla | D9/345 |
| D. 290,232 | 6/1987 | Holzkopf et al. | D9/424 |
| D. 291,533 | 8/1987 | Mangla | D9/345 |
| D. 305,409 | 1/1990 | Michaud et al. | D9/420 |
| D. 317,671 | 6/1991 | Skaggs et al. | D99/34 |
| D. 341,316 | 11/1993 | Fritz et al. | D9/429 |
| D. 352,000 | 11/1994 | Hansen et al. | D9/429 |
| D. 353,327 | 12/1994 | Castner et al. | D9/425 |
| D. 358,091 | 5/1995 | Warburton | D9/429 |
| D. 375,683 | 11/1996 | Schoff | D9/428 |
| D. 377,580 | 1/1997 | Hayes et al. | D7/392.1 |
| D. 378,180 | 2/1997 | Hayes et al. | D7/552 |
| 3,675,811 | 7/1972 | Artz | 229/406 X |
| 4,061,241 | 12/1977 | Retelny | 229/406 X |
| 4,206,845 | 6/1980 | Christian | 229/406 |
| 4,240,575 | 12/1980 | Tange | 229/29 M |
| 4,273,249 | 6/1981 | Florian | 220/4 E |
| 4,298,133 | 11/1981 | Davis | 229/406 X |
| 4,298,156 | 11/1981 | Reifers et al. | 229/2.5 R |
| 4,375,862 | 3/1983 | Kurinsky et al. | 220/293 |
| 4,383,638 | 5/1983 | Bixler | 229/45 EC |
| 4,396,147 | 8/1983 | Jackson | 229/44 EC |
| 4,463,894 | 8/1984 | Daines | 229/44 EC |
| 4,492,331 | 1/1985 | Bixler et al. | 229/2.5 EC |

(List continued on next page.)

OTHER PUBLICATIONS

Brochure: Clear View SmartLock Containers; pp. 1–4; Jan. 1997.

Products Specification Catalog: Tenneco Packaging Specialty Products; pp. 1–112; Nov. 1996.

*Primary Examiner*—Jacob K. Ackun
*Attorney, Agent, or Firm*—Arnold White & Durkee

[57] ABSTRACT

A disposable food container comprises a lid and a base optionally connected to each other along a resilient hinge. The lid includes a top wall, a continuous lid side wall, and a plurality of lid corners. The lid side wall encompasses the top wall and extends downwardly and outwardly from the top wall. The plurality of lid corners are at least partially formed by the lid side wall and include a pair of front lid corners. The base includes a bottom wall, a continuous base side wall, and a plurality of base corners. The base side wall encompasses the bottom wall and extends upwardly and outwardly from the bottom wall. The plurality of base corners are at least partially formed by the base side wall and include a pair of front base corners. If the container is provided with a resilient hinge, the pair of front lid corners and the pair of front base corners are spaced away from the hinge. The container includes a corner latch closure for releasably engaging the lid and the base in a closed position. The corner latch closure includes at least a pair of slots and at least a pair of slot engaging structures that can be interlocked with each other. The pair of slots are formed by the respective front base corners, while the pair of slot engaging structures are formed by the respective front lid corners.

13 Claims, 5 Drawing Sheets

U.S. PATENT DOCUMENTS

| | | | |
|---|---|---|---|
| 4,582,248 | 4/1986 | Bixler et al. | 229/45 EC |
| 4,625,905 | 12/1986 | Mangla | 229/2.5 EC |
| 4,653,685 | 3/1987 | Leasy et al. | 229/406 |
| 4,715,529 | 12/1987 | Bixler | 229/2.5 R |
| 4,741,452 | 5/1988 | Holzkopf | 220/306 |
| 4,742,934 | 5/1988 | Michaud et al. | 220/306 |
| 4,742,952 | 5/1988 | Bixler et al. | 229/125.36 |
| 4,771,934 | 9/1988 | Kalmanides | 229/406 |
| 4,874,083 | 10/1989 | Antoni et al. | 206/45.32 |
| 4,974,738 | 12/1990 | Kidd et al. | 220/4 B |
| 5,018,624 | 5/1991 | Arneson et al. | 206/560 |
| 5,046,659 | 9/1991 | Warburton | 229/205 |
| 5,094,355 | 3/1992 | Clark et al. | 229/406 X |
| 5,220,999 | 6/1993 | Goulette | 206/45.32 |
| 5,266,763 | 11/1993 | Colombo | 219/10.55 |
| 5,269,430 | 12/1993 | Schlaupitz et al. | 220/4.23 |
| 5,287,959 | 2/1994 | Hansen et al. | 206/45.32 |
| 5,300,748 | 4/1994 | Colombo | 219/734 |
| 5,322,182 | 6/1994 | Fritz | 220/623 |
| 5,423,453 | 6/1995 | Fritz | 220/608 |
| 5,515,993 | 5/1996 | McManus | 220/339 |
| 5,518,133 | 5/1996 | Hayes et al. | 220/306 |
| 5,577,627 | 11/1996 | Richie-Dubler | 220/4.23 |
| 5,595,769 | 1/1997 | Castner et al. | 425/183 |
| 5,607,709 | 3/1997 | Fritz et al. | 426/106 |

CONTAINER WITH A CORNER LATCH CLOSURE

FIELD OF THE INVENTION

The present invention relates generally to disposable containers and, more particularly, relates to a disposable food container having a secure corner latch closure that can be operated with one hand.

BACKGROUND OF THE INVENTION

In the food service industry, food products such as sandwiches, appetizers, and the like are commonly served to customers in disposable food containers. One type of disposable food container includes a lid and a base hingedly connected to each other along a resilient hinge. The lid is held closed by some type of latching mechanism. The efficacy of the latching mechanism has a great influence on the performance of the container and its acceptance by customers. Latching mechanisms that hold the lid closed very securely tend to be difficult for customers to open for access to the food products therein. Conversely, latching mechanisms that are easily opened are prone to accidental opening while being transported, thereby leading to spillage of the contents and extremely negative customer reactions to the container.

One common type of latching mechanism is a central front latch closure including a single slot and a single tab that can be interlocked with each other. The slot is formed in a central front portion of the base, while the tab is formed along a central front portion of the lid. A drawback of the central front latch closure is that it is prone to failure. The weak tab and slot will often break or release, thereby causing the container to accidentally open. In some cases, the container will accidentally open even when the tab and slot maintain their integrity.

SUMMARY OF THE INVENTION

Accordingly, the present invention is directed to a disposable food container comprising a lid and a base. Depending upon the requirements of the particular application involved, the lid and the base may be hingedly connected to each other along a resilient hinge. The lid includes a top wall, a continuous lid side wall, and a plurality of lid corners. The lid side wall encompasses the top wall and extends downwardly and outwardly from the top wall. The plurality of lid corners are at least partially formed by the lid side wall and include a pair of front lid corners. The base includes a bottom wall, a continuous base side wall, and a plurality of base corners. The base side wall encompasses the bottom wall and extends upwardly and outwardly from the bottom wall. The plurality of base corners are at least partially formed by the base side wall and include a pair of front base corners. If the container is provided with a resilient hinge, the pair of front lid corners and the pair of front base corners are spaced away from the hinge.

The container includes a corner latch closure for releasably engaging the lid and the base in a closed position. The corner latch closure includes at least a pair of slots and at least a pair of slot engaging structures that can be interlocked with each other. The pair of slots are formed by the respective front base corners, while the pair of slot engaging structures are formed by the respective front lid corners. The corner latch closure is advantageous in that it is secure and can be easily operated with one hand.

BRIEF DESCRIPTION OF THE DRAWINGS

Other objects and advantages of the invention will become apparent upon reading the following detailed description and upon reference to the drawings in which.

Figure 1:
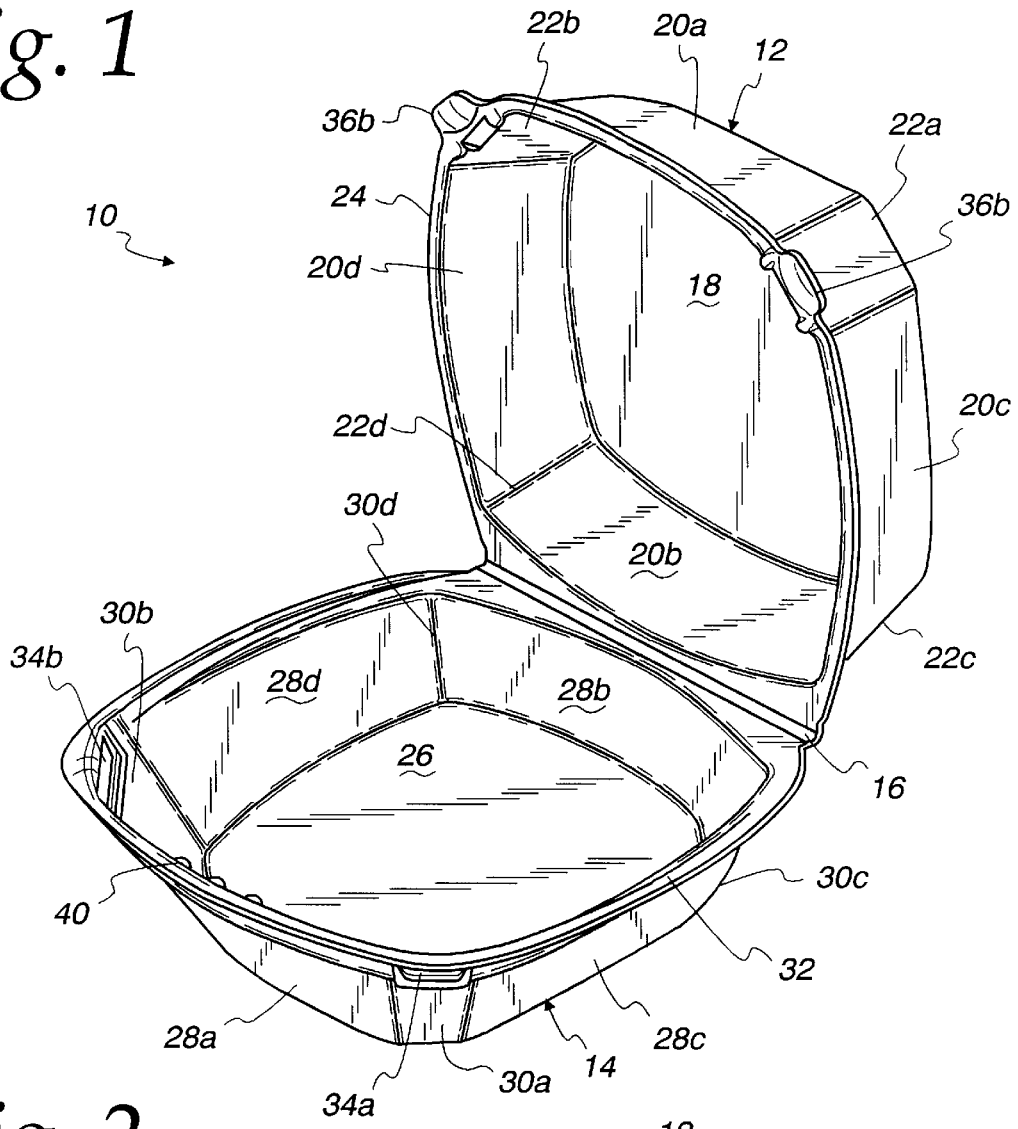
FIG. 1 is an isometric view of a disposable hinged container embodying the present invention, showing the container in an open position.

While the invention is susceptible to various modifications and alternative forms, a specific embodiment thereof has been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DESCRIPTION OF ILLUSTRATIVE EMBODIMENTS

Figure 2:
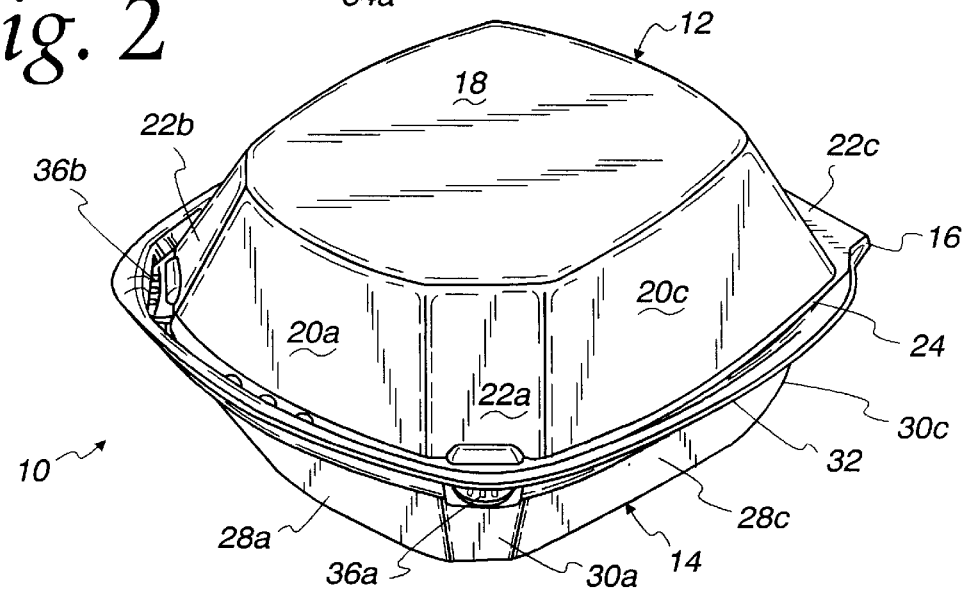
FIG. 2 is an isometric view of the container of FIG. 1 showing the container in a closed position.

Turning now to the drawings, FIGS. 1 and 2 depict a disposable container 10 embodying the present invention. FIG. 1 shows the container 10 in an open position, while FIG. 2 shows the container 10 in a closed position. The container 10 may be composed of one or more thermoplastics or thermoses that can be formed or molded, including but not limited to polystyrene foam, oriented polystyrene, a form of polyethylene terephthalate such as CPET or APET, polypropylene, and high-density polyethylene. Alternatively, the container 10 may be composed of paperboard or molded fiber/pulp.

The container 10 comprises a lid 12 and a base 14. Since the container 10 may easily be turned upside down, the lid 12 may alternatively serve as a "base" and the base 14 may alternatively serve as a "lid." Thus, the terms "lid" and "base" as used herein are intended to include container portions that function as either a lid or a base. In the embodiment of the present invention illustrated in FIGS. 1 and 2, the lid 12 and the base 14 are hingedly connected to each other along a resilient hinge 16 and are each generally square in shape.

The lid 12 includes a top wall 18, a continuous lid side wall 20, and a plurality of lid corners 22*a–d*. The lid side wall 20 encompasses the top wall 18 and extends downwardly and outwardly from the top wall 18. The plurality of lid corners 22*a–d* are at least partially formed by the lid side wall 20 and include a pair of front lid corners 22*a–b* and a pair of rear lid corners 22*c–d*. The pair of front lid corners 22*a–b* are spaced away from the resilient hinge 16, while the pair of rear lid corners 22*c–d* are in close proximity to the hinge 16.

The continuous lid side wall 20 preferably forms a pair of opposing front and back walls 20*a–b* and a pair of opposing side walls 20*c–d*. The side walls 20*c–d* bridge the opposing front and back walls 20*a–b*. Although the lid 12 is generally rectangular in shape, the front and back walls 20*a–b* and the side walls 20*c–d* are outwardly curved to give the lid 12 a somewhat rounded appearance. Alternatively, these four walls may be straight. The front lid corner 22*a* joins the front wall 20*a* and the side wall 20*c*; the front lid corner 22*b* joins the front wall 20*a* and the side wall 20*d*; the rear lid corner 22*c* joins the back wall 20*b* and the side wall 20*c*; and the rear lid corner 22*d* joins the back wall 20*b* and the side wall 20*d*. The lid 12 preferably includes a first lip or trim area 24 encompassing a lower edge of the continuous lid side wall 20 and extending laterally outwardly therefrom.

The base 14 includes a bottom wall 26, a continuous base side wall 28, and a plurality of base corners 30*a–d*. The base side wall 28 encompasses the bottom wall 26 and extends upwardly and outwardly from the bottom wall 26. The plurality of base corners 30*a–d* are at least partially formed by the base side wall and include a pair of front base corners 30*a–b* and a pair of rear base corners 30*c–d*. The pair of front base corners 30*a–b* are spaced away from the resilient hinge 16, while the pair of rear base corners 30*c–d* are in close proximity to the hinge 16.

The continuous base side wall 28 preferably forms a pair of opposing front and back walls 28*a–b* and a pair of opposing side walls 28*c–d*. The side walls 28*c–d* bridge the opposing front and back walls 28*a–b*. Although the base 14 is generally rectangular in shape, the front and back walls 28*a–b* and the side walls 28*c–d* are outwardly curved to give the base 14 a somewhat rounded appearance. Alternatively, these four walls may be straight. The front base corner 30*a* joins the front wall 28*a* and the side wall 28*c*; the front base corner 30*b* joins the front wall 28*a* and the side wall 28*d*; the rear base corner 30*c* joins the back wall 28*b* and the side wall 28*c*; and the rear base corner 30*d* joins the back wall 28*b* and the side wall 28*d*. The base 14 preferably includes a second lip or trim area 32 encompassing an upper edge of the continuous base side wall 28 and extending laterally outwardly therefrom. The portion of the first lip 24 extending from the back wall 20*b* and the portion of the second lip 32 extending from the back wall 28*b* are joined along the resilient hinge 16.

An advantageous feature of the container 10 involves the manner in which the lid 12 and the base 14 are latched to close the container 10 as depicted in FIG. 2. To releasably engage the lid 12 and the base 14, the container 10 includes a corner latch closure having a pair of front corner slots 34*a–b* and a pair of slot engaging structures 36*a–b* that can be interlocked with each other. The pair of slots 34*a–b* are formed by the respective front base corners 30*a–b*, while the pair of slot engaging structures 36*a–b* are formed by the respective front lid corners 22*a–b*. Since the container 10 is hinged, only a pair of such slots and a pair of such slot engaging structures are required to engage the lid 12 and the base 14 at their front corners. As discussed below in connection with FIGS. 10 and 11, additional slots and slot engaging structures are preferably used in the absence of the resilient hinge 16 to permit engagement of the lid and the base at all their corners.

Figure 6:
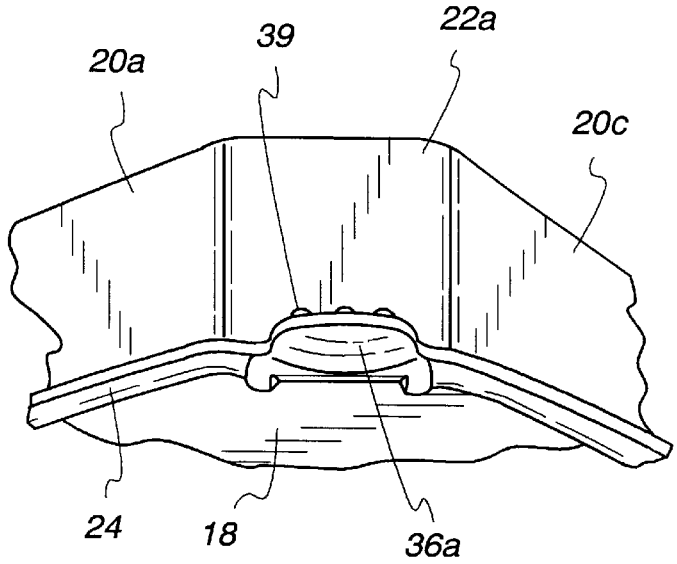
FIG. 6 is an enlarged partial isometric view of a base of the container of FIG. 1 showing a slot of the corner latch closure.

FIG. 6 is an enlarged partial isometric view of the base 14 showing the slot 34*a* of the corner latch closure in greater detail. The slot 34*b* is identical to the slot 34*a* so they both are described below with reference to FIG. 6. The sheared slots 34*a–b* are preferably located just below the lip 32. To facilitate shearing of the slots 34*a–b*, the front base corners 30*a–b* containing the respective slots 34*a–b* are generally flat. Alternatively, depending upon the requirements of the particular application involved, the corners 30*a–b* may be rounded. The inclusive (interior) angle between the front base corner 30*a* and the front wall 28*a* is approximately the same as the inclusive angle between the front base corner 30*a* and the side wall 28*c*. Likewise, the inclusive angle between the front base corner 30*b* and the front wall 28*a* is approximately the same as the inclusive angle between the front base corner and the side wall 28*d*.

To further facilitate the formation of the slots 34*a–b*, the slots 34*a–b* are preferably trapezoidal in shape, where the wider portions of the trapezoidal slots 34*a–b* are closest to the lip 32. The trapezoidal shape of the slots 34*a–b* also serves to strengthen the narrow corner portions 38 between the lip 32 and the slots 34*a–b* by densifying the container material around the slots 34*a–b*. Further information concerning the manufacture and use of trapezoidal slots and their attendant advantages may be obtained from U.S. Pat. No. 5,596,769 to Castner et al., which is incorporated herein by reference in its entirety.

Figure 7:
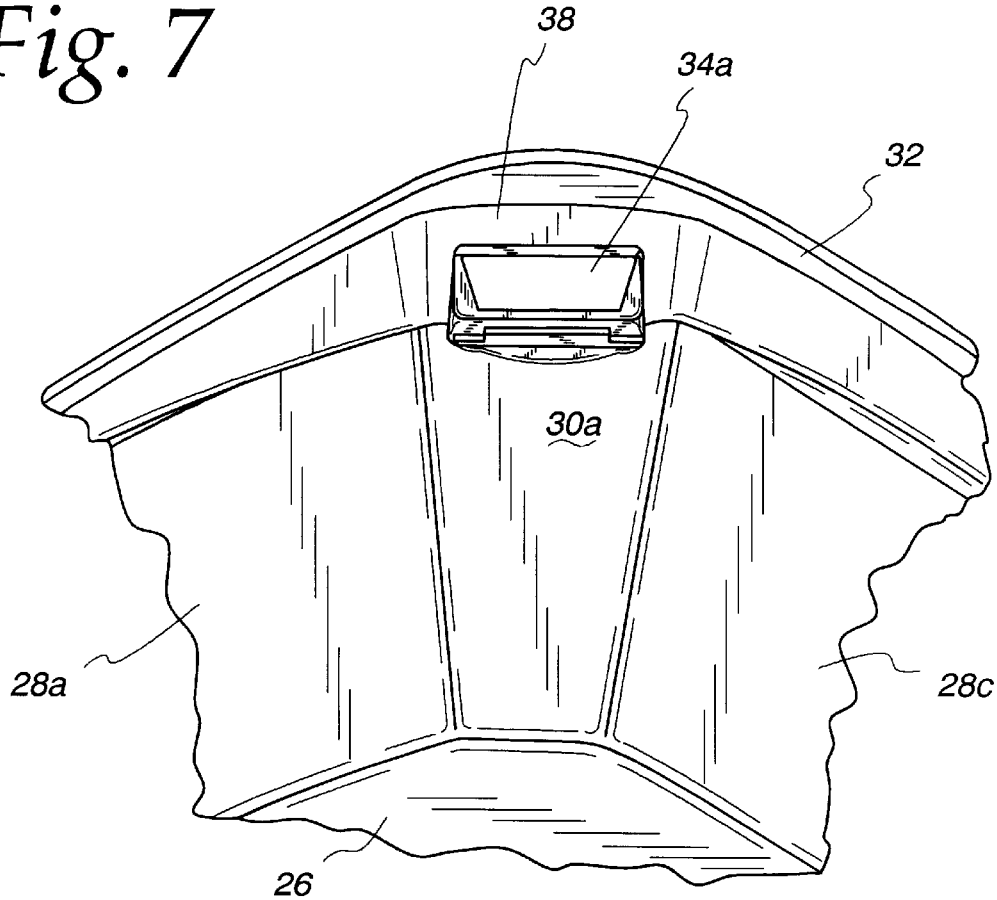
FIG. 7 is an enlarged partial isometric view of a lid of the container of FIG. 1 showing a slot engaging structure of the corner latch closure.

FIG. 7 is an enlarged partial isometric view of the lid 12 showing the slot engaging structure 36*a* of the corner latch closure in greater detail. The slot engaging structure 36*b* is identical to the slot engaging structure 36*a* so they both are described below with reference to FIG. 7. The slot engaging structures 36*a–b* are preferably in the form of resilient spoon-shaped tabs extending in a laterally outward direction from the lip 24. The tabs 36*a–b* are spoon-shaped or "hooked" in the sense that they are convex when viewed from below as in FIG. 7 and are concave when viewed from above. The upper/concave side of the spoon-shaped tabs 36*a–b* forms a plurality of linear reinforcing ribs 39 extending in a laterally outward direction from the lip 24.

Figure 3:
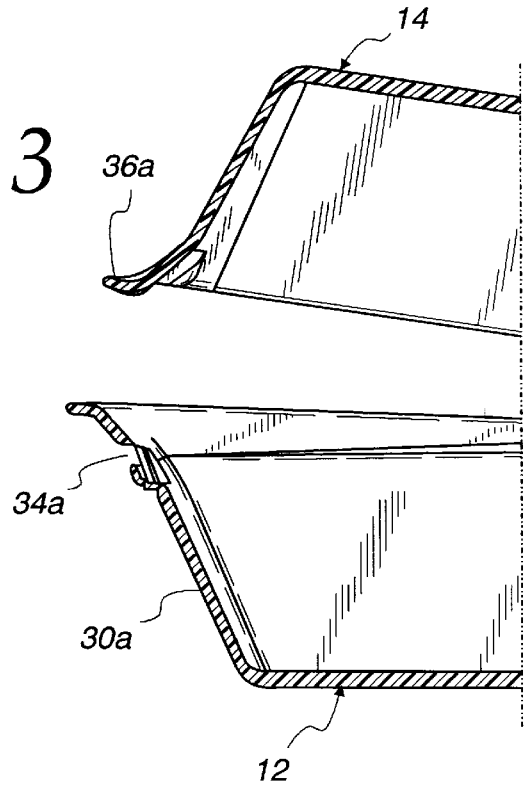
FIG. 3 is a partial section view of the container of FIG. 1 showing a corner latch closure in an unlatched state.
Figure 4:
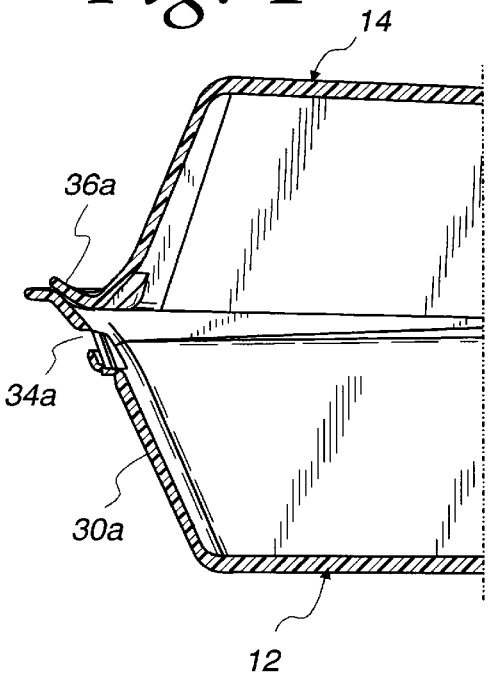
FIG. 4 is partial section view of the container of FIG. 1 showing the corner latch closure in the process of being latched.
Figure 5:
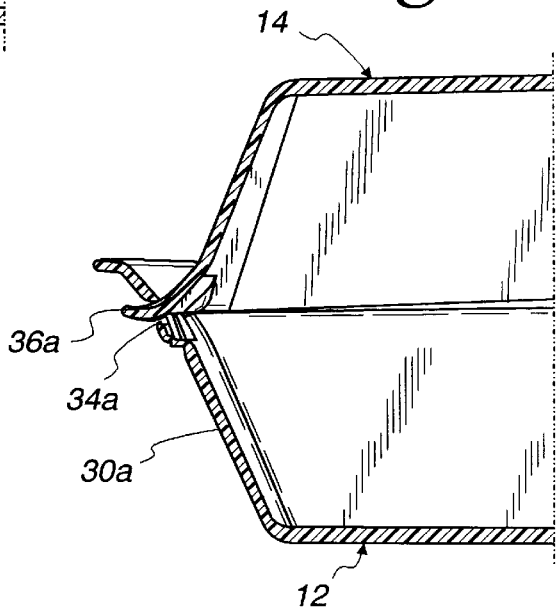
FIG. 5 is a partial section view of the container of FIG. 1 showing the corner latch closure in a latched state.

FIGS. 3, 4, and 5 depict the process of closing the lid 14 and latching the corner latch closure. In FIG. 3, the corner latch closure is completely unlatched. Referring to FIG. 4, as the lid 14 is rotated downward toward the base 12 during the closing process, the tabs 36*a–b* on the lid 14 align with the respective slots 34*a–b*. The tabs 36*a–b* then bear against the respective front base corners 30*a–b* just prior to engaging with the respective slots 34*a–b*. FIG. 4 depicts the tab 36*a* bearing against the inner surface of the front base corner 30*a*. The interference between the tabs 36*a–b* and the respective front base corners 30*a–b* causes the resilient tabs 36*a–b* to temporarily flex or bow inwardly. This flexing of the tabs 36*a–b* is readily apparent in FIG. 4, which shows the tab 36*a* flexed inwardly by comparison with the unflexed tab 36*a* in FIG. 3. The spoon-shaped geometry of the tabs 36*a–b* facilitates their flexing. Referring to FIG. 5, when the tabs 36*a–b* encounter the respective slots 34*a–b* during the closing process, the tabs 36*a–b* snap into the respective slots 34*a–b* thereby latching the corner latch closure. The spoon-shaped geometry of the tabs 36*a–b* helps to retain the tabs 36*a–b* in the respective slots 34*a–b*, thereby minimizing the possibility that the container 10 will accidentally open.

The corner latch closure formed by the resilient spoon-shaped tabs 36*a–b* and the trapezoidal slots 34*a–b* can be latched and unlatched using one hand and is more secure than the aforementioned prior art central front latch closures. The trapezoidal shape of the slots 34*a–b* and their placement at the base corners increases their strength. The spoon-shaped geometry of the tabs 36 allows them to flex in one direction (see FIG. 4) to facilitate latching of the corner latch closure and, at the same time, resists flexing in the opposite direction to prevent accidental unlatching of the corner latch closure once it has been latched.

Figure 8:
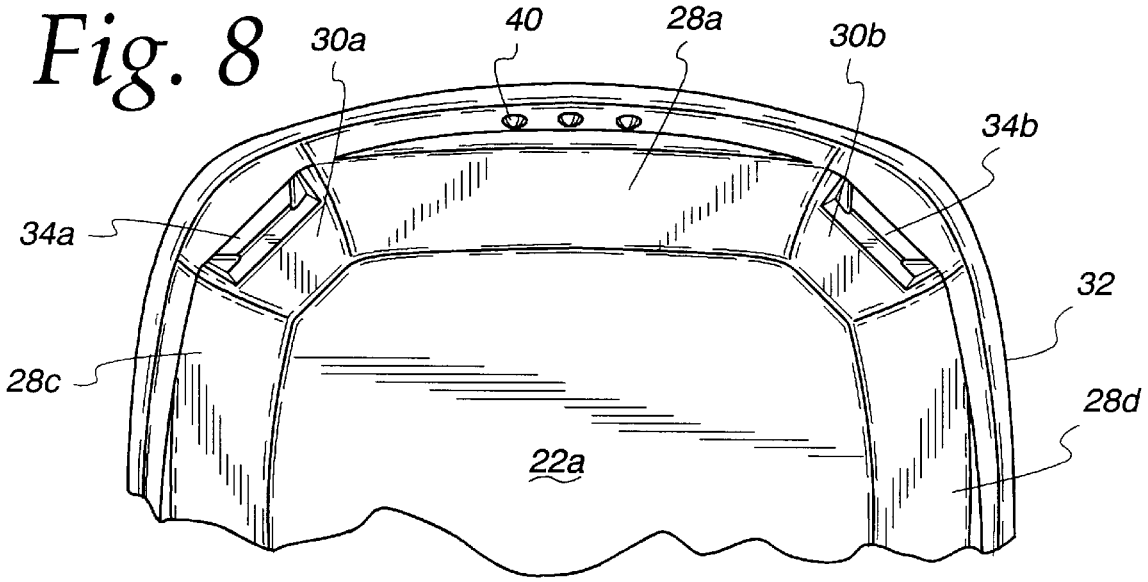
FIG. 8 is a partial top view of the base of the container of FIG. 1 showing inward protrusions along a front wall of the base.
Figure 9:
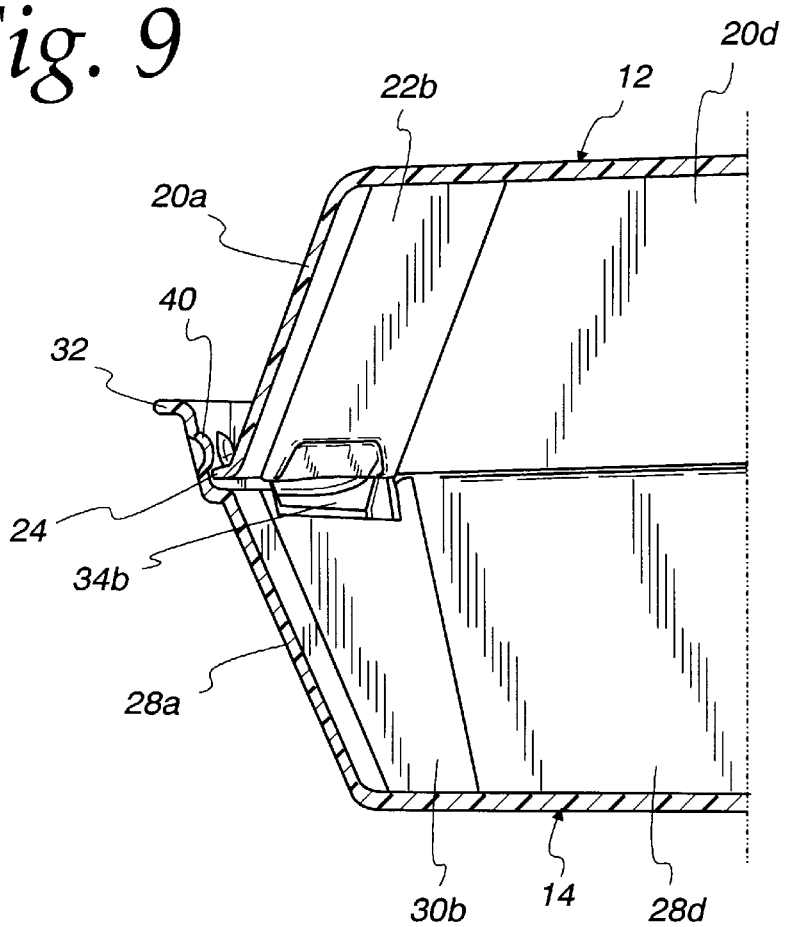
FIG. 9 is a partial section view of the container of FIG. 1 showing a lip of the lid engaged beneath the inward protrusions along the front wall of the base.

Referring to FIGS. 8 and 9, the front wall 28*a* of the base 14 forms a plurality of inward protrusions or dimples 40. The protrusions 40 further minimize the possibility that the container 10 will accidentally open. When the container 10 is in the closed position, the protrusions 40 help to retain the lip 24 of the lid 12 beneath the protrusions 40. This, in turn, reduces the possibility that the corner latch closure will accidentally become unlatched. Although FIG. 8 depicts three inward protrusions 40, the number of protrusions may be varied depending upon the requirements of the particular application involved.

Figure 10:
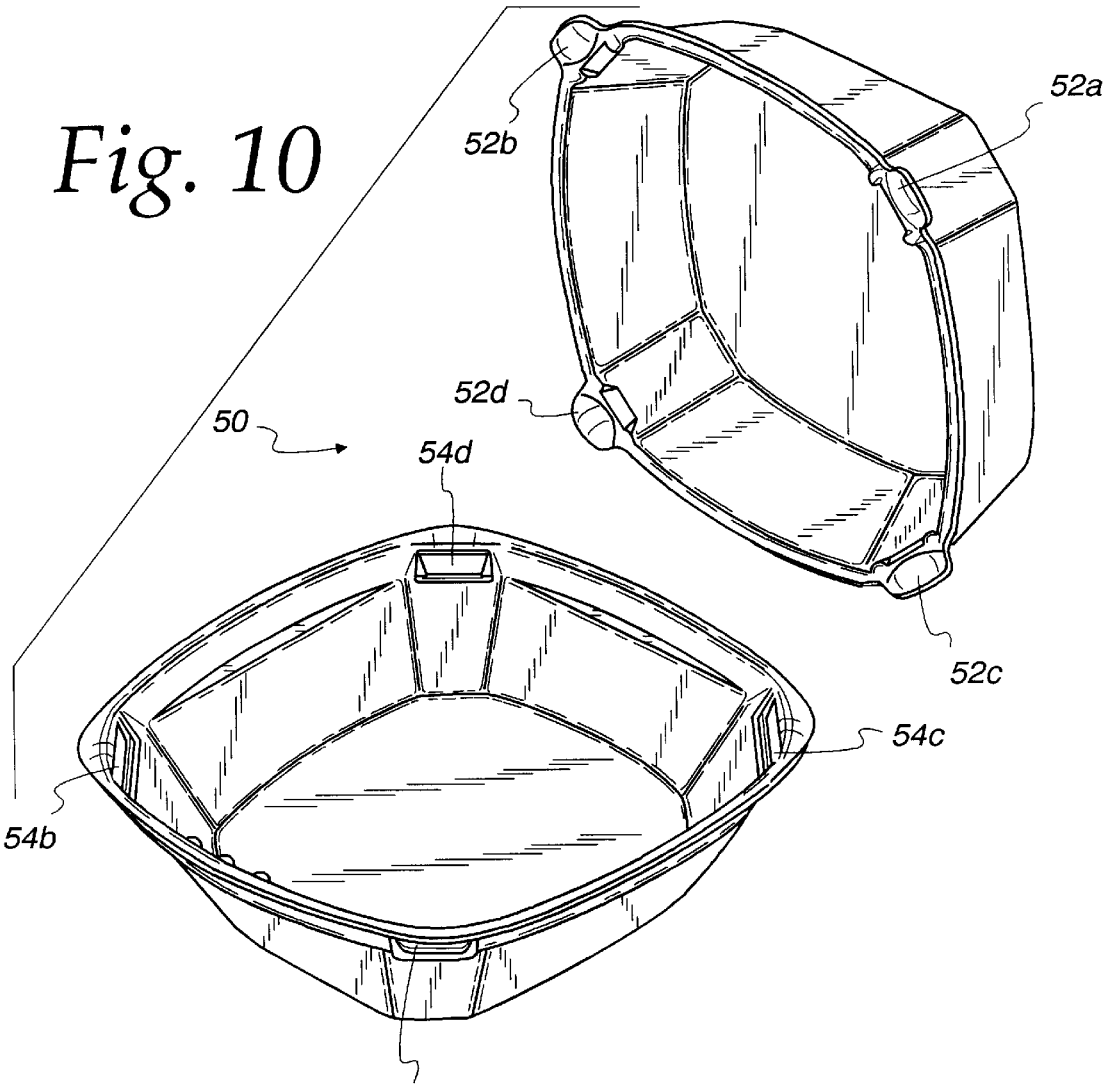
FIG. 10 is an isometric view of a disposable unhinged container embodying the present invention, showing the container in an open position.
Figure 11:
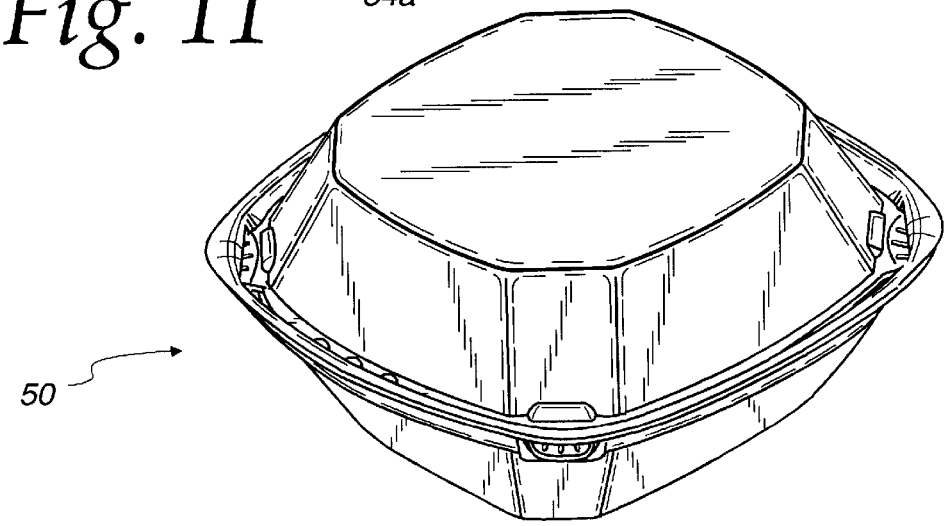
FIG. 11 is an isometric view of the container of FIG. 10 showing the container in a closed position.

Referring now to FIGS. 10 and 11, the corner latch closure described above may be applied to an unhinged container 50. FIG. 10 shows the container 50 in an open position, while FIG. 11 shows the container 50 in a closed position. Since the container 50 is unhinged, the container 50 includes corresponding spoon-shaped tabs 52*a–d* and sheared trapezoidal slots 54*a–d* at each of its four corners. The corners are generally flat to facilitate formation of the sheared slots 54*a–d*.

While the present invention has been described with reference to one or more particular embodiments, those skilled in the art will recognize that many changes may be made thereto without departing from the spirit and scope of the present invention. For example, the tabs of the corner latch closure may be substituted with other slot engaging structures such as corner buttons formed on outwardly-biased corner latch flaps. If, for example, the container 10 of FIG. 1 were modified to include the corner buttons, a pair of outwardly-biased latch flaps would be attached to the lip 24 at the respective corners 22*a–b*, and each of the latch flaps would form a respective button. Further information concerning the construction and operation of such latch flaps and buttons may be obtained from U.S. Pat. No. 5,595,769. The locations and sizes of the slots 34*a–b* along their respective corners may be modified to best accommodate the alternative slot engaging structures. Each of these embodiments and obvious variations thereof is contemplated as falling within the spirit and scope of the claimed invention, which is set forth in the following claims.

What is claimed is:

1. A disposable food container, comprising:

a lid including a top wall, a continuous lid side wall, and a plurality of lid corners, said lid side wall encompassing said top wall and extending downwardly and outwardly from said top wall, said plurality of lid corners being at least partially formed by said lid side wall and including a pair of front lid corners;

a base including a bottom wall, a continuous base side wall, and a plurality of base corners, said base side wall encompassing said bottom wall and extending upwardly and outwardly from said bottom wall, said plurality of base corners being at least partially formed by said base side wall and including a pair of front base corners; and a corner latch closure for releasably engaging said lid and said base in a closed position, said corner latch closure including at least a pair of slots and at least a pair of spoon-shaped tabs, said spoon-shaped tabs being concave on respective upper sides thereof and convex on respective lower sides thereof, said pair of slots being interlockable with said respective pair of spoon-shaped tabs, said pair of slots being formed by said respective front base corners, said pair of spoon-shaped tabs being formed by said respective front lid corners.

2. The container of claim 1, wherein said lid includes a lip encompassing a lower edge of said continuous lid side wall and extending laterally outwardly therefrom, and wherein said spoon-shaped tabs extend laterally outward from said lip.

3. The container of claim 1, wherein said continuous lid side wall forms a pair of opposing front and back lid walls and a pair of opposing lid sides, said lid sides bridging said opposing front and back lid walls, and wherein said continuous base side wall forms a pair of opposing front and back base walls and a pair of opposing base sides, said base sides bridging said opposing front and back base walls.

4. The container of claim 3, wherein said lid and said base are each generally rectangular in shape.

5. The container of claim 1, wherein said lid and said base are connected to each other along a resilient hinge, said pair of front lid corners and said pair of front base corners being spaced away from said hinge.

6. The container of claim 1, wherein said lid and said base are unhinged, said plurality of lid corners includes a pair of rear lid corners, and said plurality of base corners includes a pair of rear base corners, and wherein said corner latch closure includes another pair of slots and another pair of slot engaging structures, said another pair of slots being interlockable with said respective another pair of slot engaging structures, said another pair of slots being formed by said respective rear base corners, said another pair of slot engaging structures being formed by said respective rear lid corners.

7. The container of claim 1, wherein said lid includes a lip encompassing a lower edge of said continuous lid side wall and extending laterally outwardly therefrom, and wherein said continuous base side wall forms a plurality of inward dimples, said inward dimples retaining said lip of said lid beneath said dimples when the container is in said closed position, said base side wall including a solid section immediately beneath said dimples, said lip contacting said solid section when the container is in said closed position.

8. The container of claim 7, wherein said continuous base side wall includes a front base wall extending between said pair of front base corners, and wherein said inward dimples are formed by said front base wall.

9. A latch closure for releasably engaging a lid and a base of a disposable food container in a closed position, said lid including a top wall, a continuous lid side wall, and a plurality of lid corners, said lid side wall encompassing said top wall and extending downwardly and outwardly from said top wall, said plurality of lid corners being at least partially formed by said lid side wall and including a pair of front lid corners, said base including a bottom wall, a continuous base side wall, and a plurality of base corners, said base side wall encompassing said bottom wall and extending upwardly and outwardly from said bottom wall, said plurality of base corners being at least partially formed by said base side wall and including a pair of front base corners, said latch closure comprising:

at least a pair of slots formed by said respective front base corners; and at least a pair of spoon-shaped tabs formed by said respective front lid corners, said pair of slots being interlockable with said respective pair of spoon-shaped tabs, said spoon-shaped tabs being concave on respective upper sides thereof and convex on respective lower sides thereof.

10. The latch closure of claim 9, wherein said lid includes a lip encompassing a lower edge of said continuous lid side wall and extending laterally outwardly therefrom, and wherein said spoon-shaped tabs extend laterally outward from said lip.

11. The latch closure of claim 9, wherein said lid and said base are unhinged, said plurality of lid corners includes a pair of rear lid corners, and said plurality of base corners includes a pair of rear base corners, and further including another pair of slots and another pair of slot engaging structures, said another pair of slots being interlockable with said respective another pair of slot engaging structures, said another pair of slots being formed by said respective rear base corners, said another pair of slot engaging structures being formed by said respective rear lid corners.

12. The latch closure of claim 9, wherein said lid includes a lip encompassing a lower edge of said continuous lid side wall and extending laterally outwardly therefrom, and further including a plurality of inward dimples formed by said continuous base side wall, said inward dimples retaining said lip of said lid beneath said dimples when the container is in said closed position, said base side wall including a solid section immediately beneath said dimples, said lip contacting said solid section when the container is in said closed position.

13. The latch closure of claim 12, wherein said continuous base side wall includes a front base wall extending between said pair of front base corners, and wherein said inward dimples are formed by said front base wall.

* * * * *